US008998735B2

(12) United States Patent
Tsai

(10) Patent No.: US 8,998,735 B2
(45) Date of Patent: Apr. 7, 2015

(54) GAME TABLE ASSEMBLY STRUCTURE

(75) Inventor: Jerry Tsai, Taichung (TW)

(73) Assignee: Zhejiang Elephant Sport Co., Ltd., Jiashan, Zhejiang (CN)

( * ) Notice: Subject to any disclaimer, the term of this patent is extended or adjusted under 35 U.S.C. 154(b) by 210 days.

(21) Appl. No.: 13/572,604

(22) Filed: Aug. 10, 2012

(65) Prior Publication Data

US 2014/0045601 A1 Feb. 13, 2014

(51) Int. Cl.
*A63D 15/00* (2006.01)

(52) U.S. Cl.
CPC ..... *A63D 15/00* (2013.01)

(58) Field of Classification Search
CPC ..... A63D 15/00; A63D 15/06
USPC ..... 473/1, 4, 29, 31, 33
See application file for complete search history.

(56) References Cited

U.S. PATENT DOCUMENTS 170,059 A * 11/1875 Collender ..... 473/33
280,198 A * 6/1883 Ludwig ..... 473/33
4,027,878 A * 6/1977 Dadbeh ..... 473/29
4,989,863 A * 2/1991 Hall ..... 473/15
5,161,797 A * 11/1992 Frasca ..... 473/29
5,839,966 A * 11/1998 Eisenhauer et al. ..... 473/29
6,132,320 A * 10/2000 Spoerl et al. ..... 473/29
7,223,177 B2 * 5/2007 Tarbell ..... 473/30
7,654,911 B2 * 2/2010 Cartwright ..... 473/33
7,828,668 B1 * 11/2010 Tippit ..... 473/15
8,033,923 B2 * 10/2011 Chung ..... 473/14
8,033,924 B2 * 10/2011 Cartwright ..... 473/33

* cited by examiner

*Primary Examiner* — Mitra Aryanpour
(74) *Attorney, Agent, or Firm* — Guice Patents PLLC

(57) ABSTRACT

A game table assembly structure includes a table frame and a table face board, the table frame is composed of two pairs of sideboards. Four connection boards are disposed on top edges of the sideboards. At least one support board is disposed in the table frame with two ends connected with a pair of sideboards. The top edge of the support board is higher than the connection boards. Four connecting boards are connected under the bottom face of the table face board and define a locating space therein. When assembled, the table face board is placed on the table frame with the connecting boards and the connecting boards up and down corresponding to each other for connection, the top end of the support board fitted in the locating space. The table face board can be easily located on and assembled with the table frame.

19 Claims, 12 Drawing Sheets

GAME TABLE ASSEMBLY STRUCTURE

BACKGROUND OF THE INVENTION

1. Field of the Invention

The present invention relates generally to a game table, and more particularly to a game table easy to assemble.

2. Description of the Related Art

A game table allows a game or a sport to be played on in order to provide entertainment. Various game tables are commercially available, such as billiard tables, hockey game tables and soccer game tables.

A game table is typically assembled in a factory, knockdown game tables are also available. Such knockdown game tables can be conveniently assembled by the consumers.

In accordance with one aspect of the present invention, a game table is provided which includes a simple construction and it is easy to assemble.

SUMMARY OF THE INVENTION

It is therefore a primary object of the present invention to provide a game table, which can be easily assembled by a consumer.

It is a further object of the present invention to provide a game table having a table face board, which has a supported table face board.

The game table assembly of the present invention includes a table face board and a table frame, the table frame is a rectangular frame body composed of a pair of first sideboards and a pair of second sideboards; four connection boards in the form of elongated transverse slats respectively disposed on top edges of the sideboards; at least one support board disposed in the table frame, two ends of the support board are respectively connected with the two first sideboards, the top edge of the support board is higher than the connection boards; four connecting boards are fixedly connected under a bottom face of the table face board corresponding to the four connection boards.

When assembled, the table face board is placed on the top end of the table frame with the connecting boards and the connection boards corresponding to each other. The top end of the support board fits in a locating space defined between the four connecting boards. In this case, a pair of the connecting boards is restricted by the two ends of the support board, whereby the table face board can be easily located on the table frame and assembled therewith. Then, the connection boards and the connecting boards are connected by means of multiple connection members to fixedly connect the table face board with the table frame. Accordingly, the game table can be easily assembled by a consumer.

The game table may also include, two locating members disposed between the other pair of connecting boards and two connection boards. By means of the two locating sections, the two connecting boards and the two connection boards are restricted by each other. Under such circumstance, locating members facilitate positioning the table face board relative to the table frame.

The support board can further include at least one adjustment assembly. The adjustment assembly includes an adjustment rod, which can be moved up and down to adjust the height, a top end of the adjustment rod can be used to support the bottom face of the table face board, the height of the table face board can be adjusted by the adjustment assembly.

The present invention will be more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
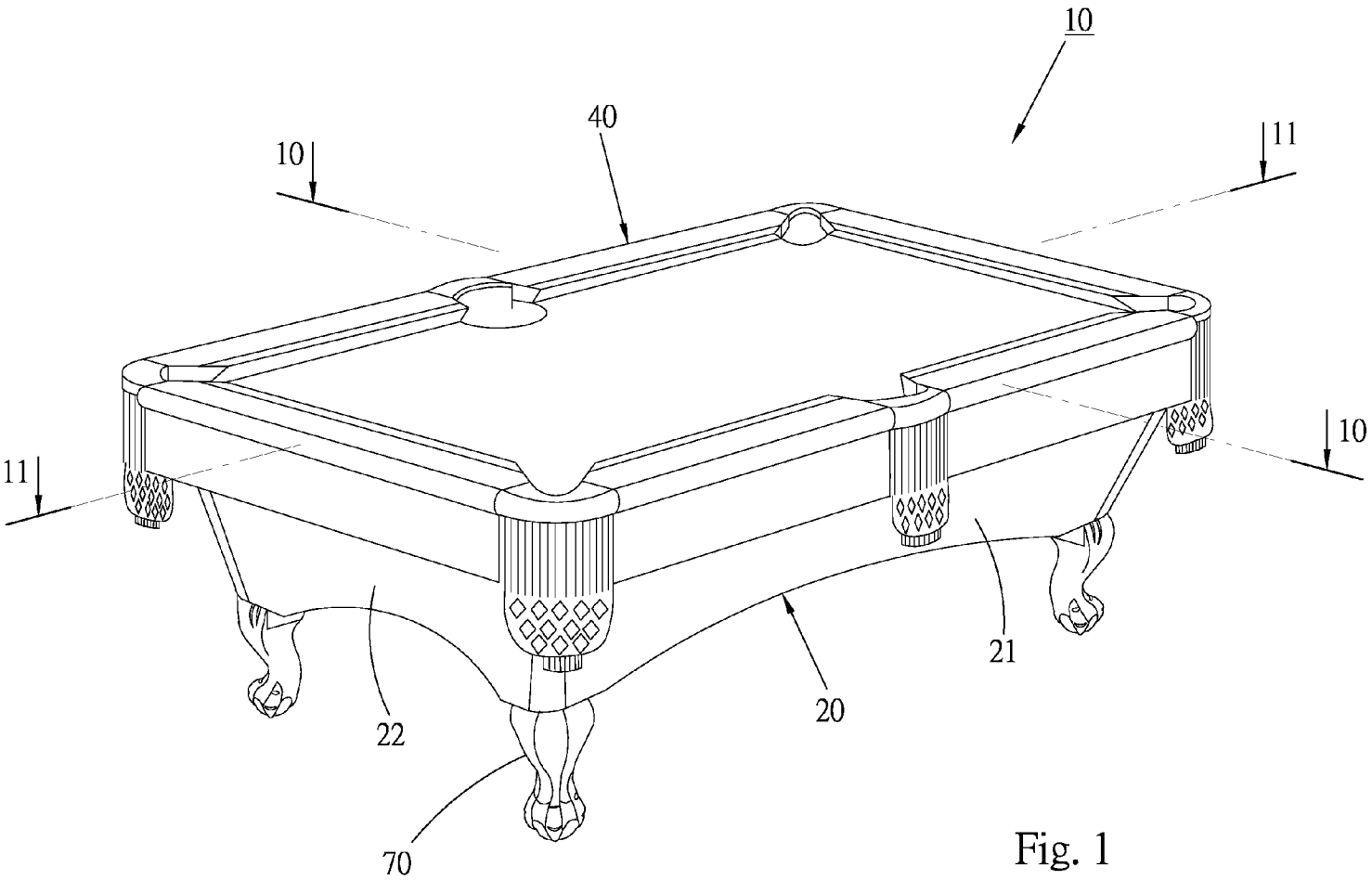
FIG. 1 is a perspective assembled view of a preferred embodiment of the present invention.
Figure 2:
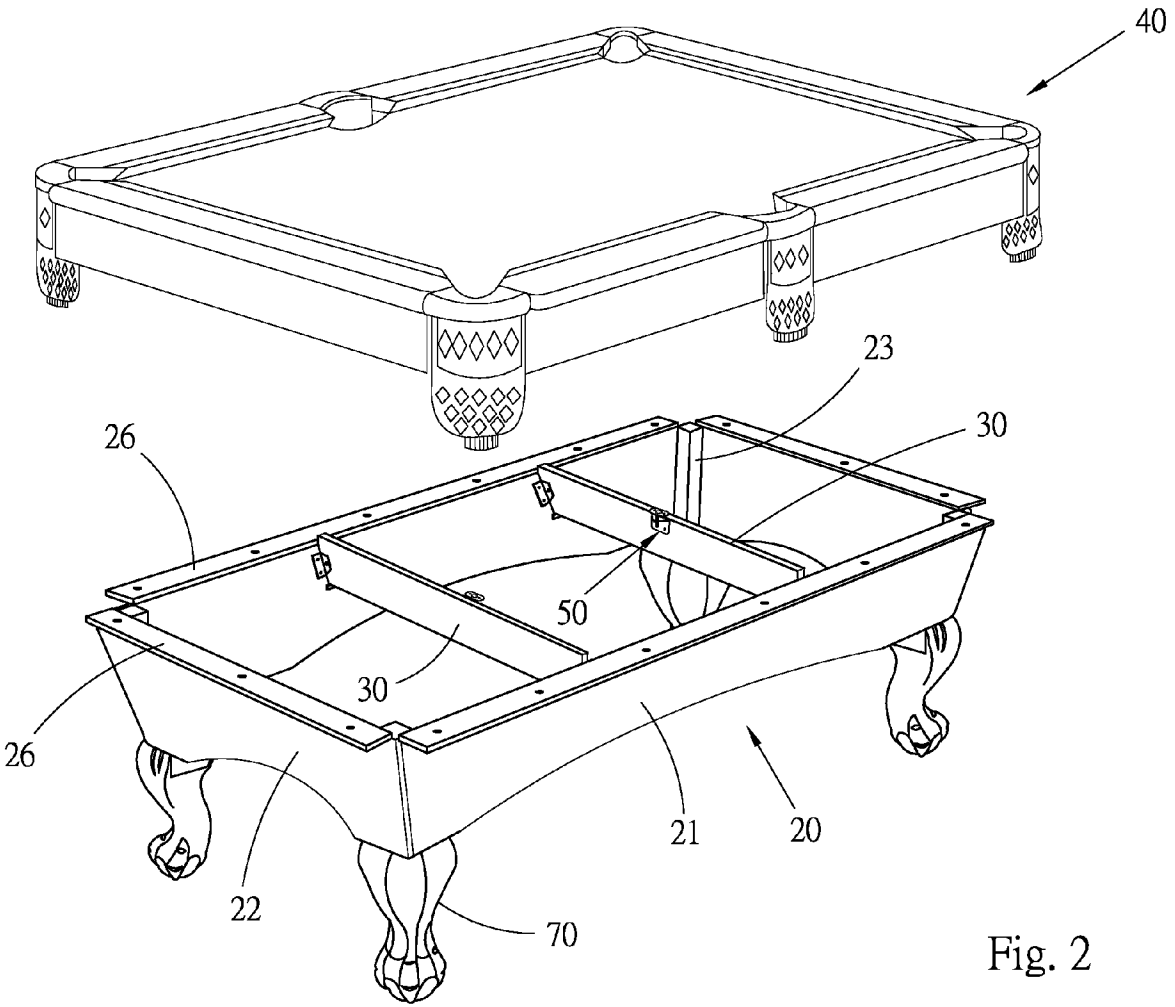
FIG. 2 is a perspective generally exploded view of the preferred embodiment of the present invention according to FIG. 1.
Figure 3:
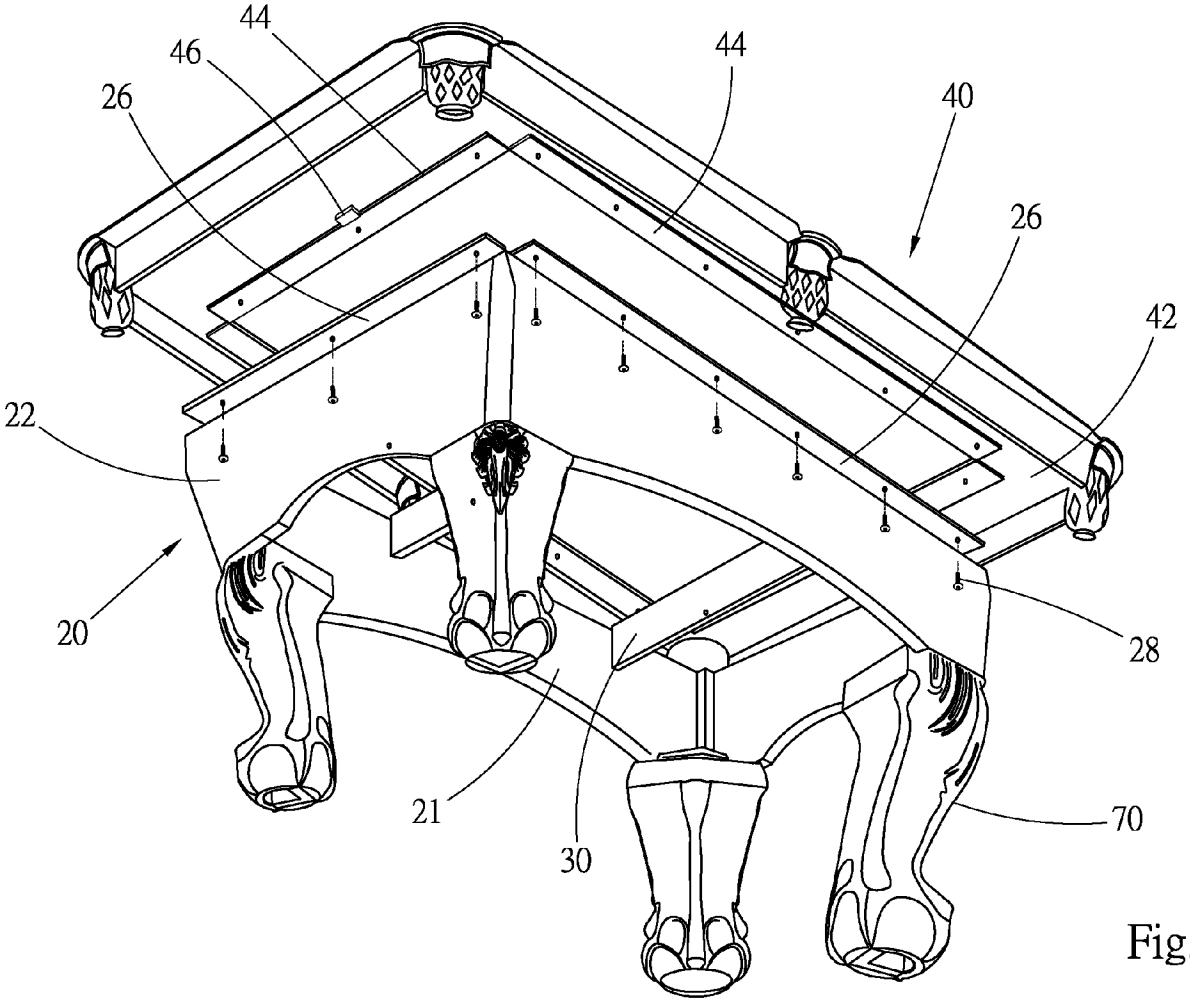
FIG. 3 is a bottom perspective generally exploded view of the preferred embodiment of the present invention.

Please refer to FIGS. 1 to 3. According to a preferred embodiment, the game table of the present invention is, but not limited to, a billiard table. Alternatively, the game table of the present invention can be a hockey game table, a soccer game table or a similar game table. The game table 10 has a table frame 20 and a table face board 40. The game table 10 of the present invention is designed as a knockdown structure so that after being purchased, a consumer can assemble the table frame 20 and combine the table frame and the table face board to form the game table. The game table 10 further has four table legs 70. The consumer also can connect the table legs with the table frame. The table legs are not the main object of the present invention and thus will not be further described hereinafter. In this embodiment, the game table is composed of various specifically designed wooden boards.

Figure 4:
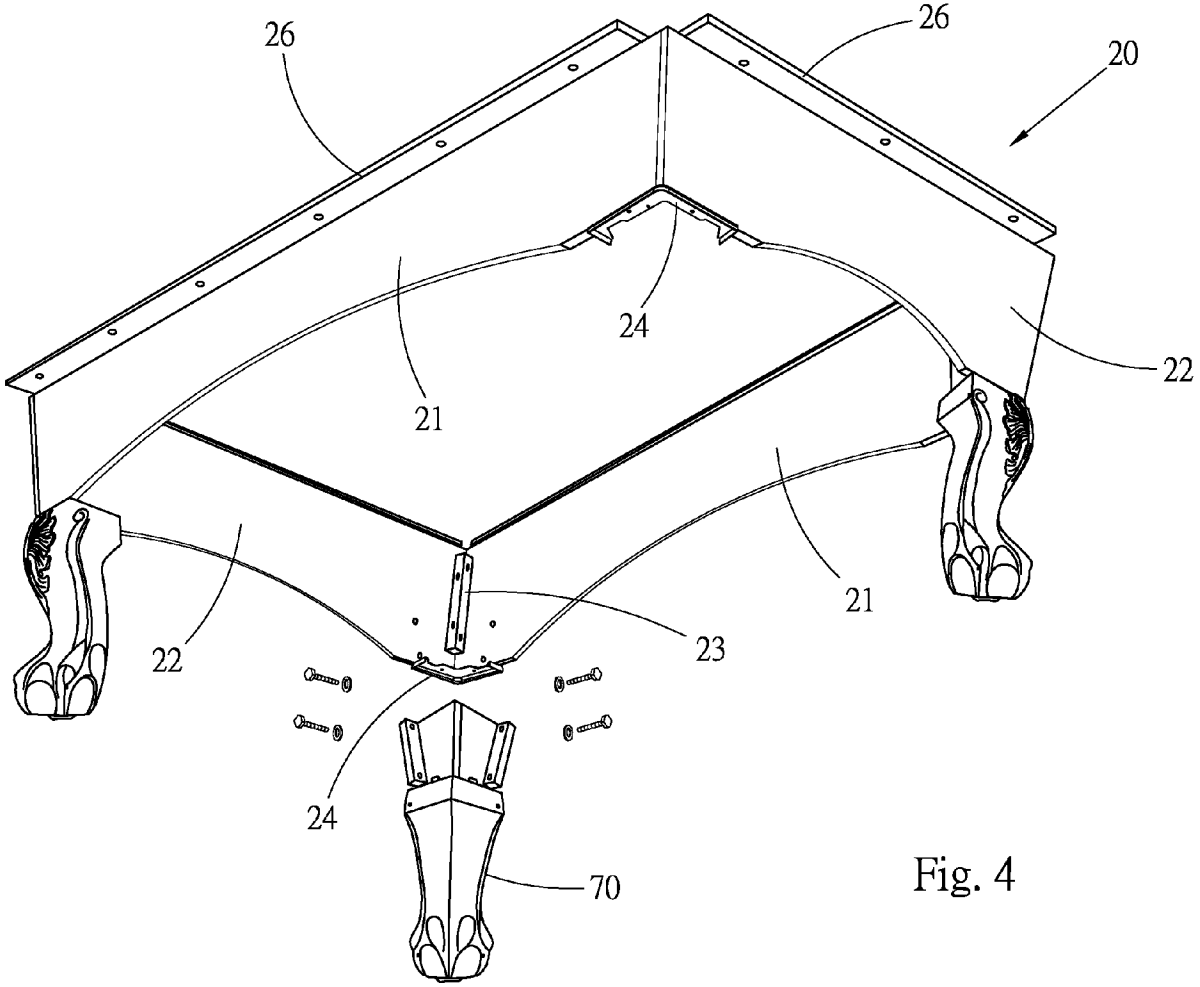
FIG. 4 is a bottom perspective view of a part of the table frame of the preferred embodiment of the present invention.

Please refer to FIGS. 2 and 4. The table frame 20 is a rectangular hollow frame body having a pair of upright first sideboards as two sideboards 21 and a pair of upright second sideboards as two end boards 22. The consumer can assemble the two sideboards 21 and the two end boards 22 into the table frame 20. One end of each sideboard 21 and one end of each end board 22 are connected with each other via a bar body 23. Two adjacent wall faces of the bar body 23 are respectively fixedly connected with an inner wall face of the sideboard and an inner wall face of the end board by means of connection members (such as screws or nails). In addition, bottom ends of the connected sections of the sideboard 21 and the end board 22 are fixedly connected with each other by means of an L-shaped angled member 24.

Figure 5A:
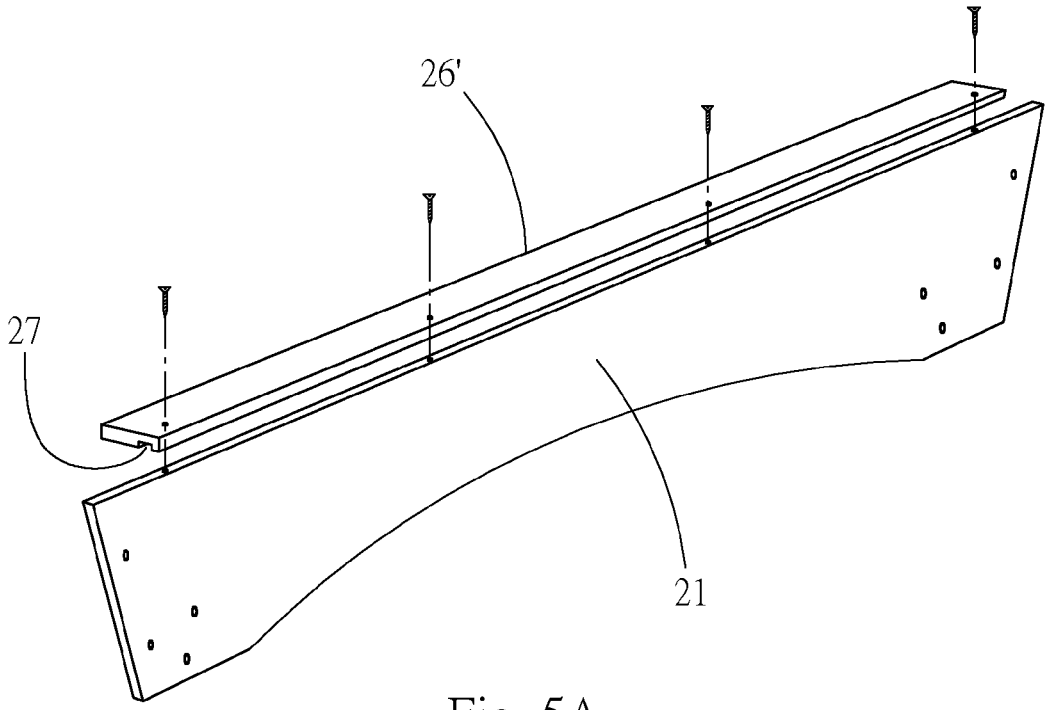
FIG. 5A is a perspective view showing the connection board and the sideboard of the preferred embodiment of the present invention.
Figure 5B:
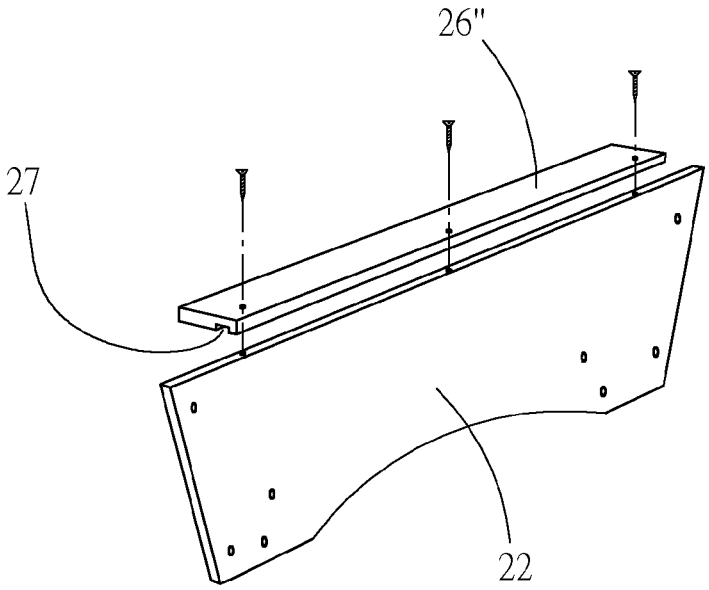
FIG. 5B is a perspective view showing the connection board and the end board of the preferred embodiment of the present invention.

Four connection boards 26 in the form of elongated transverse slats are respectively lengthwise disposed on top edges of the two sideboards 21 and the two end boards 22. In this specification and the drawings, the connection boards 26 include longer connection boards 26' and shorter connection boards 26". Please refer to FIGS. 5A and 5B. The bottom face of each connection board 26 is formed with an insertion channel 27 in which the top edge of the sideboard 21 or the end board 22 is inserted, the connection boards 26 and the two sideboards 21 and the two end boards 22 are further secured to each other by means of threaded members. The sideboards 21 and the end boards 22 are upright arranged so that after the connection boards 26 are connected with the sideboards or end boards, the connection boards 26 are kept planar and straight.

Figure 6:
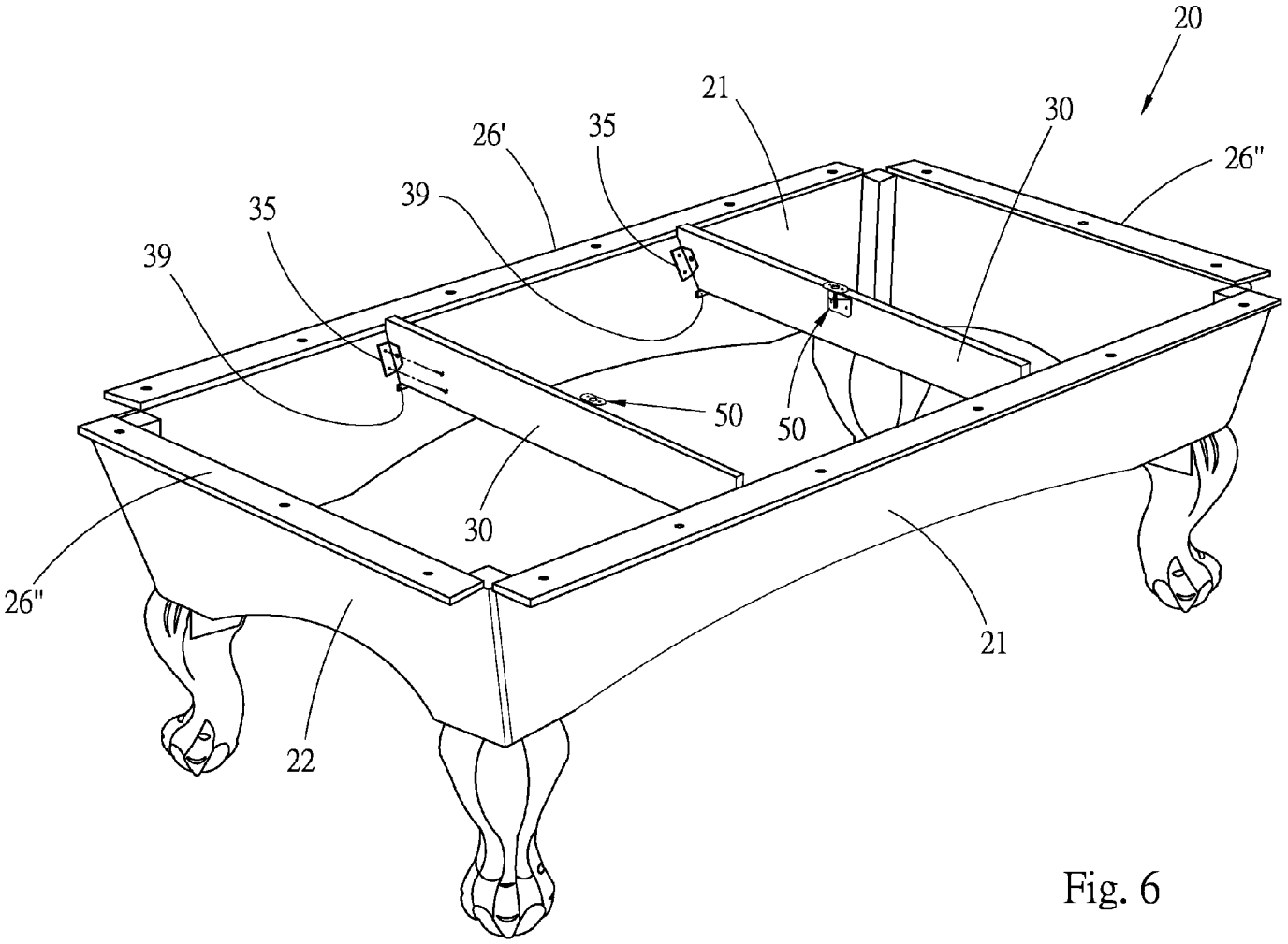
FIG. 6 is a perspective view of the table frame of the preferred embodiment of the present invention.
Figure 10:
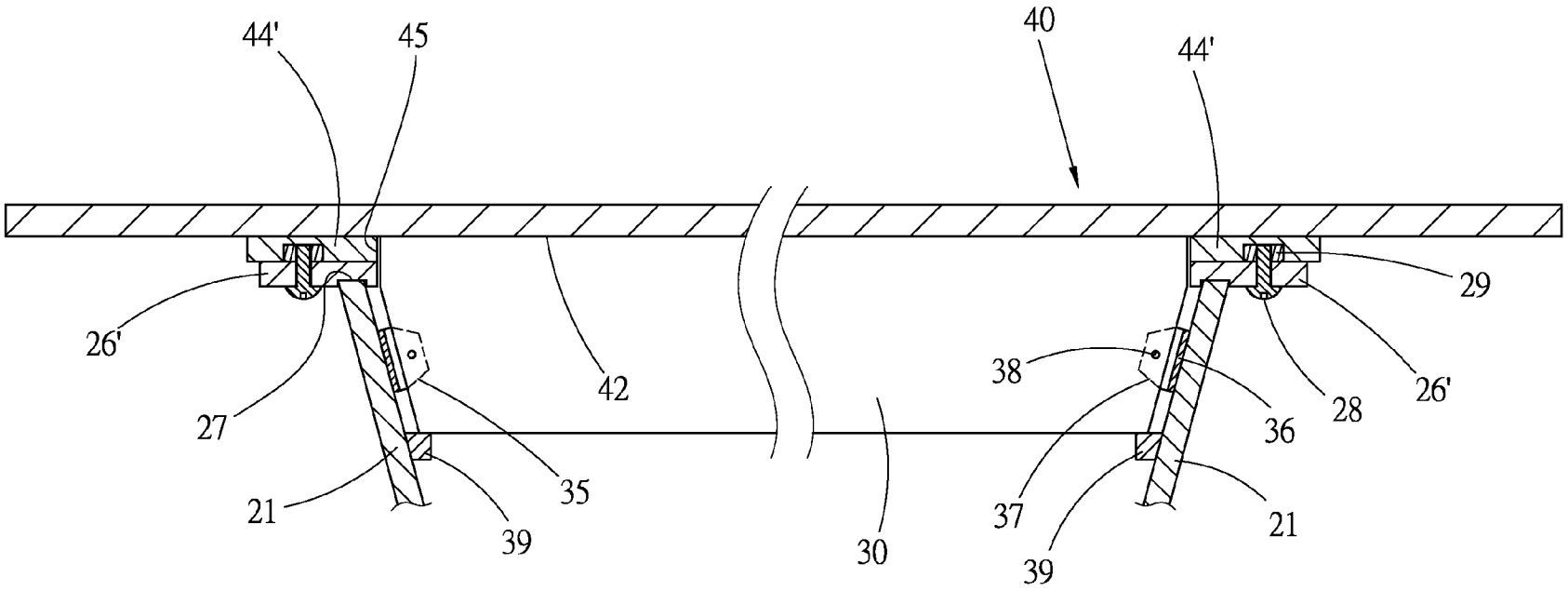
FIG. 10 is a sectional view taken along line 10-10 of FIG. 1.

One or more support boards 30 are additionally disposed in the table frame. Two support boards 30 are illustrated. Please refer to FIGS. 6 and 7. Each support board 30 is an upright board, two ends of the support board 30 are respectively connected with a pair of sideboards by means of connection members 35. The lengthwise direction of the support board 30 is positioned in a first direction of the game table. In this embodiment, two ends of the support board 30 are connected with the two sideboards 21 and the lengthwise direction of the support board 30 is positioned in the widthwise direction of the game table. Each connection member 35 has a plate-shaped main body 36 and two wing sections 37 disposed on the main body 36 and spaced from each other. The main body 36 of the connection member 35 is fixedly connected with the inner wall face of the sideboard 21. One end of the support board 30 is positioned between the Mowing sections 37. The support board 30 is connected with the wing sections 37 by means of a pin or a threaded member 38. Accordingly, two ends of the support boards 30 are respectively connected with the two sideboards 21 to pull the two sideboards toward each other without deflecting outward, and the structural strength of the table frame 20 is increased. The top edges of the support boards 30 are higher than the connection boards 26 to serve as locating points for connection between the table face board 40 and the table frame. As shown in FIGS. 6 and 10, four support blocks 39 are respectively disposed on the inner wall faces of the sideboards 21. The bottom end of each support board 30 is in contact with two support blocks 39. The support blocks 39 serve to support the support boards 30. Also, when a consumer assembles the support boards 30, the support blocks 39 serve as the locating points for the assembly.

Figure 8:
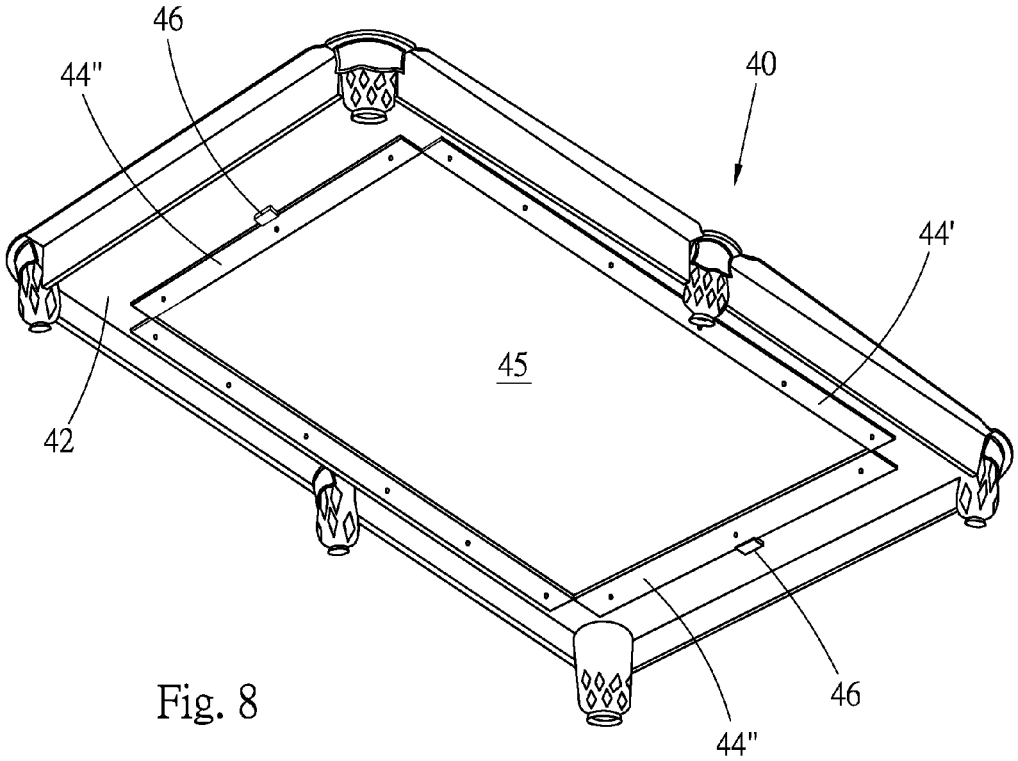
FIG. 8 is a bottom perspective view of the table face board of the preferred embodiment of the present invention.

Please refer to FIG. 8. The table face board 40 has a bottom face 42. Four connecting boards 44 are fixedly disposed under the bottom face 42 of the table face board and arranged in a rectangular form corresponding to the four connection boards 26. In this specification and the drawings, the connecting boards 44 include longer connecting boards 44' and shorter connecting boards 44". The two longer first connecting boards 44' correspond to the two longer first connection boards 26', and the two shorter second connecting boards 44" correspond to the two shorter second connection boards 26". Two locating members 46 are disposed under the bottom face 42 corresponding to a pair of connecting boards 44. The bottom ends of the locating members 46 are lower than the bottom faces of the connecting boards. The two locating members 46 are arranged in the second direction of the game table. In this embodiment, the two locating members 46 are respectively positioned on outer sides of the two shorter second connecting boards 44" and arranged in the lengthwise direction of the game table.

Figure 7:
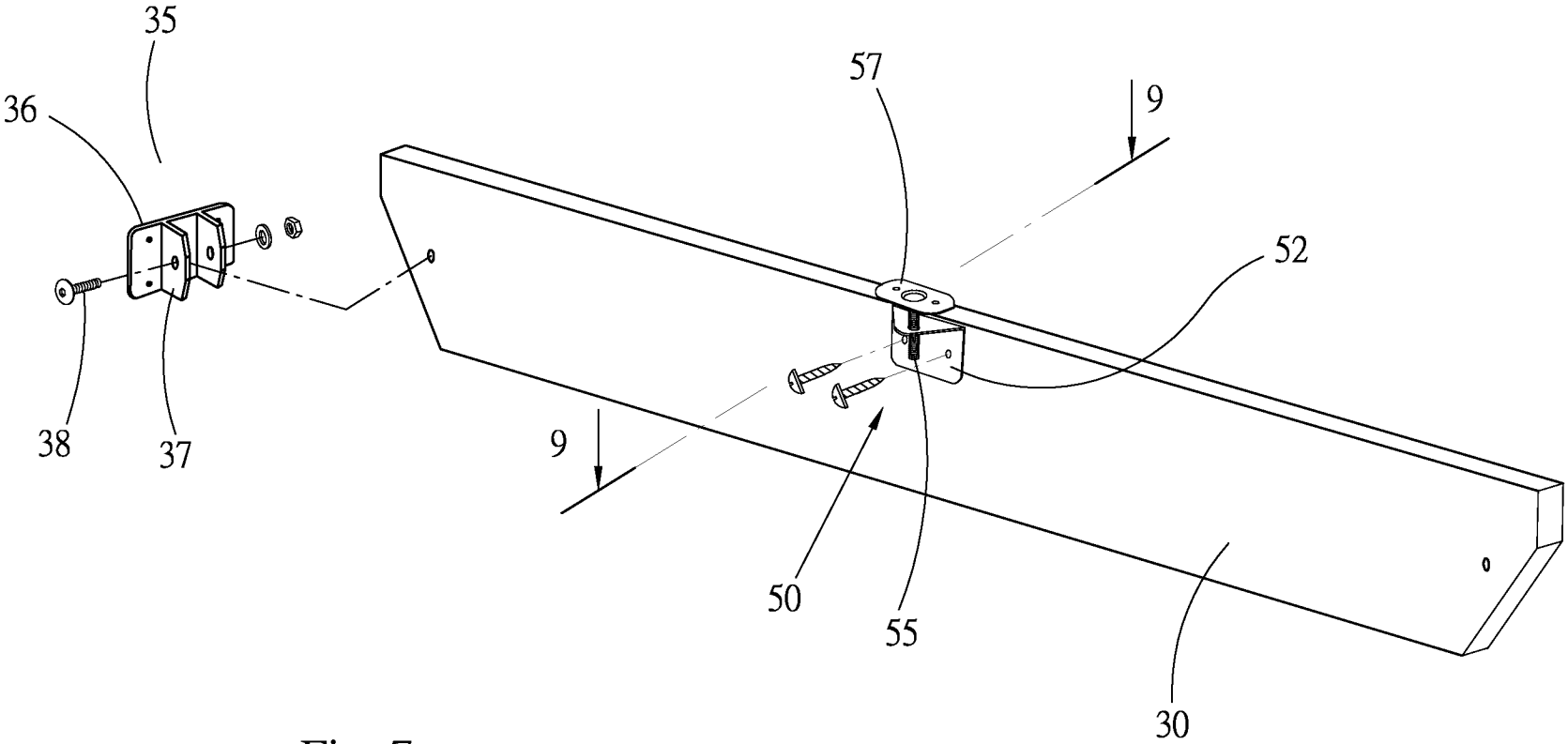
FIG. 7 is a perspective view showing the support board and the connection member of the preferred embodiment of the present invention.
Figure 9:
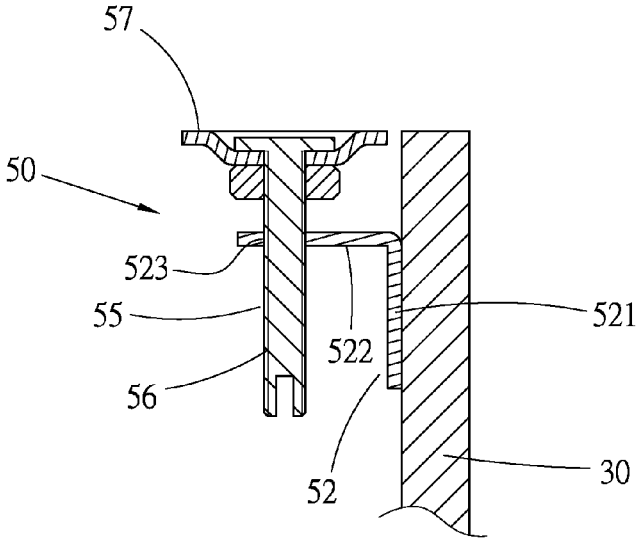
FIG. 9 is a sectional view taken along line 9-9 of FIG. 7.

Moreover, referring to FIGS. 7 and 9, each support board 30 is provided with an adjustment assembly 50. The adjustment assembly 50 includes a seat section 52 and an adjustment rod 55. The seat section 52 is an L-shaped plate body having a vertical wall 521 and a transverse wall 522. The vertical wall 521 is fixedly connected with the support board 30. The adjustment rod 55 has a threaded rod section 56 and a top section 57 disposed at a top end of the threaded rod section 56. Preferably, the top section 57 is rotatably disposed at the top end of the threaded rod section 56. The threaded rod section 55 of the adjustment rod 54 is screwed in a threaded hole 523 of the transverse wall 522 of the seat section 52. Accordingly, when rotating the threaded rod section 56, the height of the adjustment rod 55 is adjustable.

After the table frame 20 is completely assembled by the consumer, the table frame 20 can be connected with the table face board 40. When assembled, the table face board 40 is placed on the top end of the table frame 20 to be assembled therewith. By means of the structure of the present invention, the table face board can be easily located on the table frame to facilitate the assembling process. Please refer to FIG. 8. The connecting boards 44 positioned under the bottom face of the table face board 40 serve as a locating frame defining a locating space 45 therein. Further referring to FIG. 10, after the table face board 40 is placed onto the table frame 20, the top ends of the two support boards 30 are fitted in the locating space 45 and positioned between the connecting boards 44. In the widthwise direction of the game table, the inner wall faces of the pair of longer first connecting boards 44' are respectively restricted by two ends of the two support boards 30 to provide a locating effect. Also, referring to FIG. 11, in the lengthwise direction of the game table, the two locating members 46 are restricted by the pair of shorter second connection boards 26" to provide a locating effect. By means of the above locating design, the table face board 40 can be easily located on the table frame 20 and assembled therewith. It should be noted that the word "restricted" in the specification means a restriction relationship. It is unnecessary for the inner wall faces of the connecting boards 44' to actually contact the support boards 30. Also, it is unnecessary for the locating members 46 to actually contact the connection boards 26".

Figure 11:
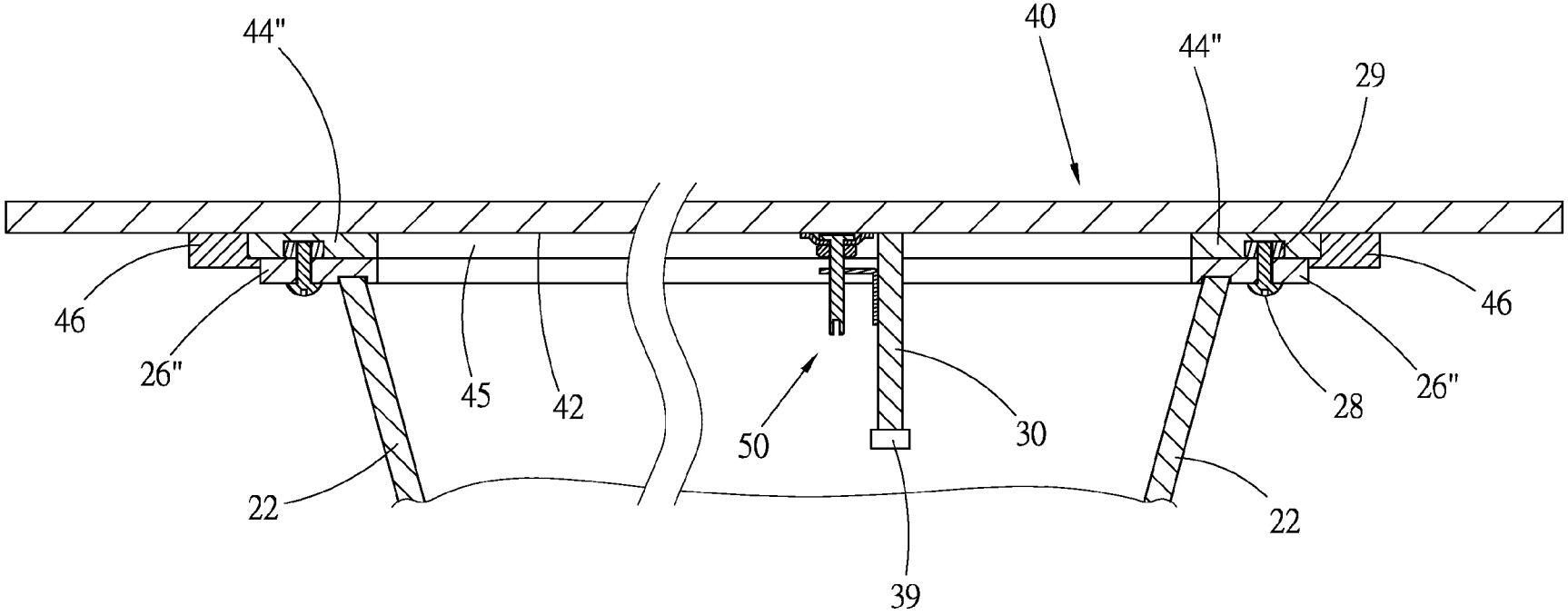
FIG. 11 is a sectional view taken along line 11-11 of FIG. 1.

It can be understood from FIG. 11, the two locating members 45 can be integrally formed on the two connecting boards 44". That is, each connecting board 44 could have a locating section for locating the connection board 26. Alternatively, the two locating members 45 can be disposed on inner wall faces of the two end boards 22 with the top ends of the locating members higher than the connection boards 26. In this case, the inner wall faces of the two shorter connecting boards 44" could be restricted by the two locating members to achieve the same locating effect.

After the table face board 40 is located on the table frame 20, the connecting boards 44 and the connection boards 26 are up and down overlapped as shown in FIG. 10. At this time, the consumer can use multiple connection members 28 (screws or nails) to connect the connecting boards 44 with the connection boards 26 so as to fixedly connect the table face board with the table frame. In this embodiment, the connection members 28 are bolts which can be upwardly passed through the connection boards 26 and screwed into the connection members 29 (such as nuts) embedded in the connecting boards 44. As the connection boards 26 are flat and straight, when the connecting boards 44 are connected with the connection boards 26, the connecting boards 44 and the table face board 40 are kept planar and straight.

Figure 12:
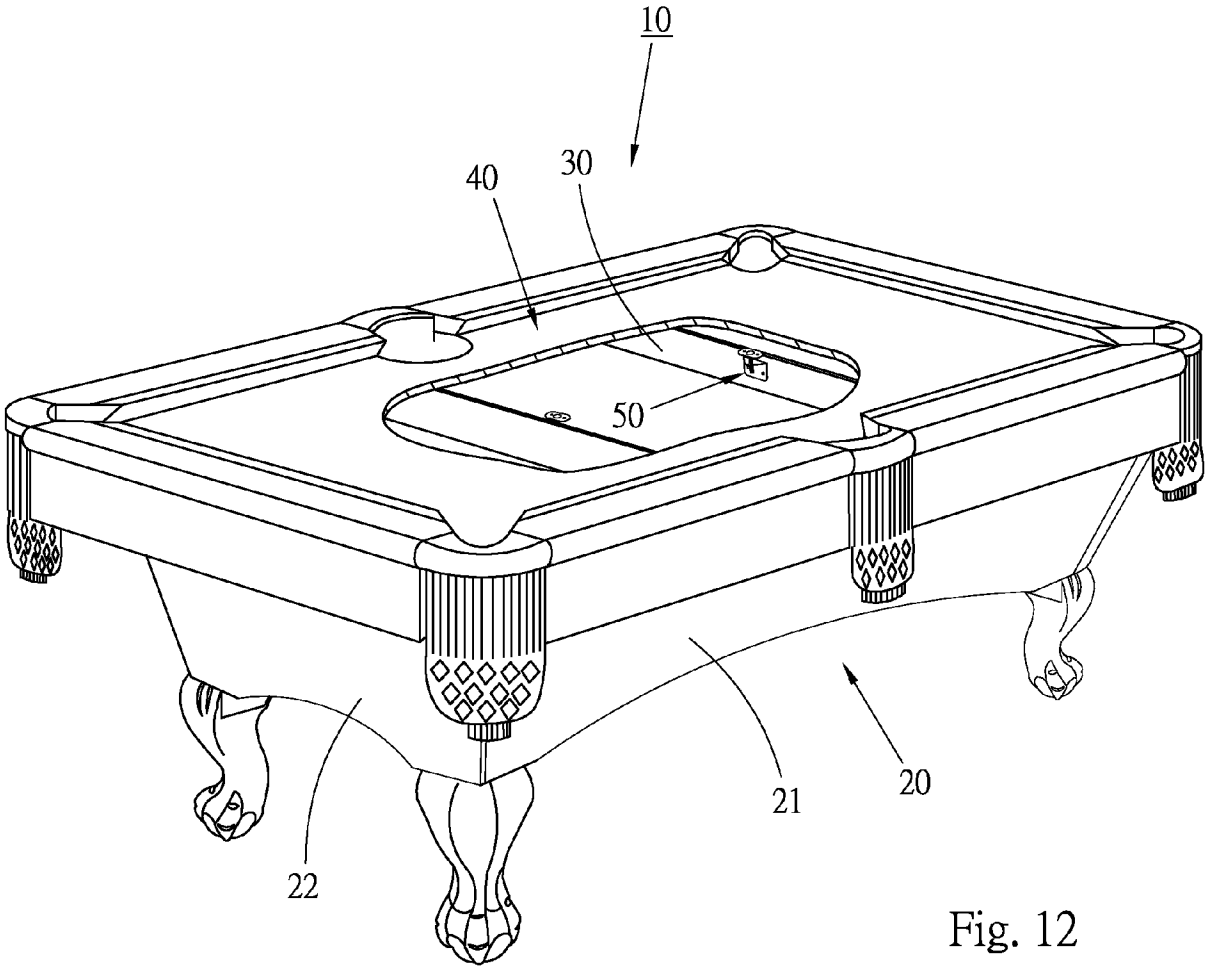
FIG. 12 is a perspective partially sectional view of the preferred embodiment of the present invention.
Figure 13:
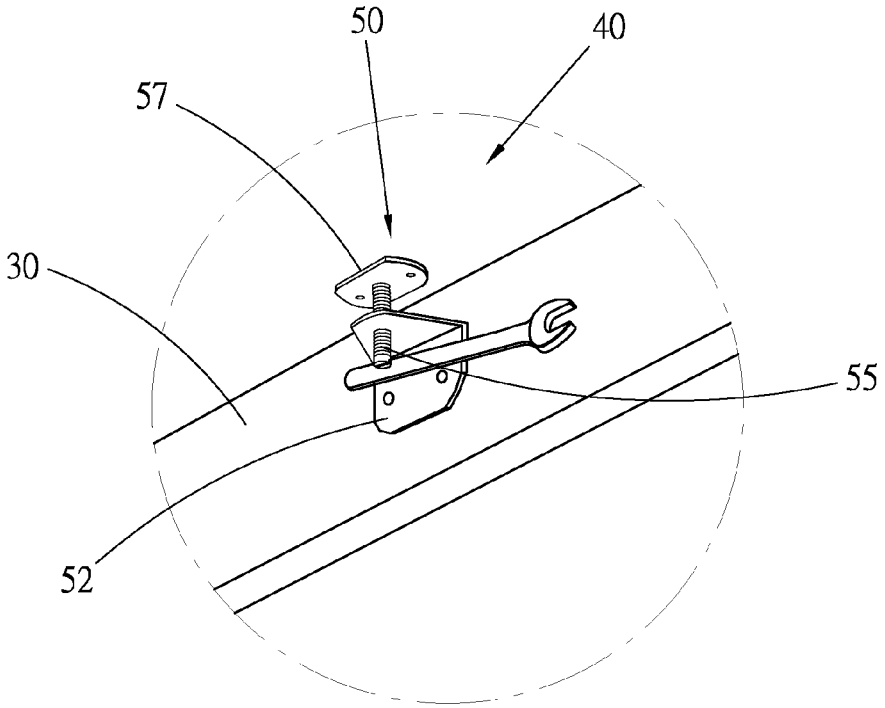
FIG. 13 is a perspective view showing that the adjustment assembly of the preferred embodiment of the present invention is adjusted.

Please refer to FIG. 12. After the table face board is connected with the table frame, the table face board 40 is supported by the two support boards 30 and/or the top sections 57 of the adjustment assemblies 50. The top sections 57 can be fixedly connected with the bottom face 42 of the board 40. In addition, as shown in FIG. 13, a user can use a tool to rotate the adjustment rod 55 to lift or lower the adjustment rod 55. Accordingly, the height of the central section of the table face board 40 can be adjusted to avoid depression of the table face board.

Figure 14:
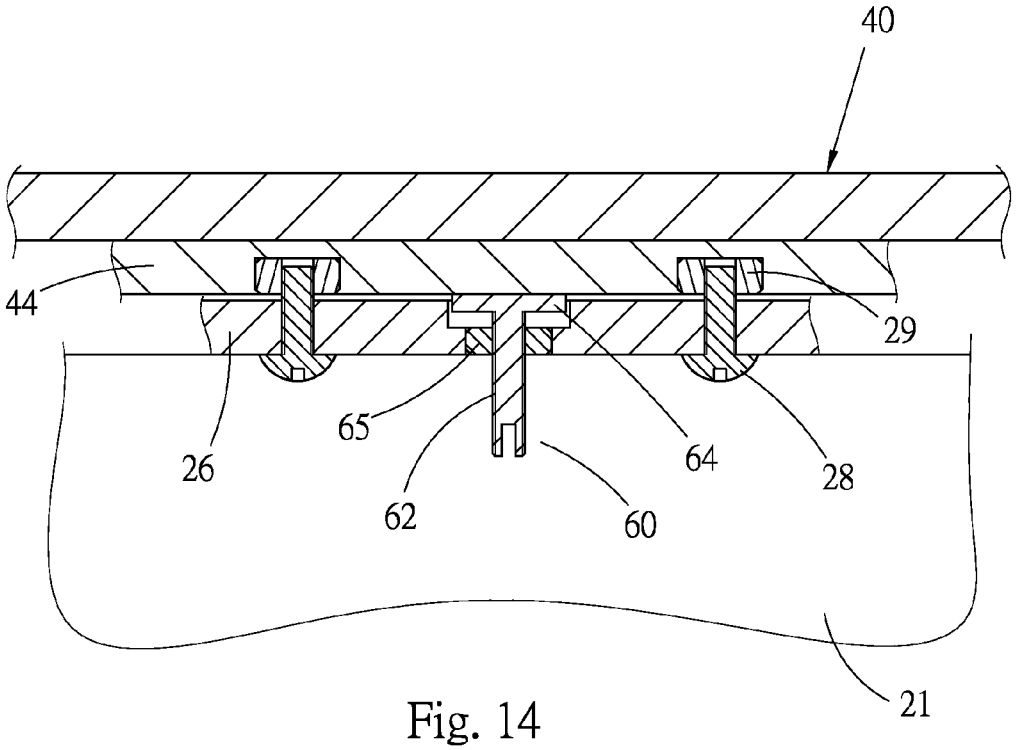
FIG. 14 is a sectional view of the preferred embodiment of the present invention.

Please refer to FIG. 14. In addition to the above structure, each connection board 26 is provided with at least one threaded member 60. The at least one threaded member 60 has a threaded rod section 62 and a top section 64 disposed at a top end of the threaded rod section 62. The threaded rod section 62 is screwed in a nut 65 embedded in the connection board. The threaded member 60 can be rotated to make the top section 64 support the connecting board 44 or directly support the table face board 40. Accordingly, the height and level of the table face board 40 can be adjusted. Alternatively, by means of a seat section as the seat section 52 of the adjustment assembly 50, the threaded member 60 can be mounted on a connection board or a sideboard of the table frame 40 instead of being directly mounted on the connection board 26.

The game table of the present invention has a simple structure so that a consumer can conveniently assemble the game table. Moreover, the game table of the present invention is designed with locating structure so that a consumer can easily locate the table face board on the table frame and the difficulty in assembly is reduced.

The above embodiments are only used to illustrate the present invention, not intended to limit the scope thereof. Many modifications of the above embodiments can be made without departing from the spirit of the present invention.

What is claimed is:

1. A game table assembly structure comprising:

a table frame being a rectangular frame body and having two sideboards and two end boards;

a table face board having a bottom face;

four connection boards in the form of elongated transverse slats, two first connection boards of the four connection boards being located on and connected to top edges of the two sideboards of the table frame; two second connection boards of the four connection boards being located on and connected to top edges of the two end boards of the table frame;

at least one support board located in the table frame, two ends of the at least one support board being respectively connected with the two sideboards, a top edge of the at least one support board being located at a position that is higher than a location of top edges of the four connection boards;

four connecting boards being elongated and fixedly connected to the bottom face of the table face board, the four connecting boards corresponding with and being directly connected to the four connection boards, two first connecting boards of the four connecting boards corresponding with the two first connection boards; two second connecting boards of the four connecting boards corresponding with the two second connection boards; a locating space being defined between the four connecting boards;

the table face board is located above of the table frame, the four connecting boards and the four connection boards are located between the table face board and the table frame, a top portion of the at least one support board being located in the locating space defined by the four connecting boards, the two first connecting boards being restricted by two ends of the at least one support board; and the four connection boards and the four connecting boards are connected together by multiple connection members thereby fixedly connecting the table face board with the table frame.

2. The game table assembly structure as claimed in claim 1, further comprising two locating members located on an outer side of the two second connecting boards and the two second connection boards, the two locating members restricting the two second connecting boards and the two second connection boards.

3. The game table assembly structure as claimed in claim 1, further comprising two locating members located under the bottom face of the table face board and corresponding with the two second connecting boards respectively, bottom edges of the two locating members extending lower than the two second connecting boards, the two locating members restricting the two second connection boards.

4. The game table assembly structure as claimed in claim 1, wherein each said at least one support board has at least one adjustment assembly, the adjustment assembly including an adjustment rod, the adjustment rod is moveable up and down to adjust a height thereof, a top section being located at a top end of the adjustment rod for supporting the bottom face of the table face board.

5. The game table assembly structure as claimed in claim 2, wherein each said at least one support board has at least one adjustment assembly, the adjustment assembly including an adjustment rod, the adjustment rod is moveable up and down to adjust a height thereof, a top section being located at a top end of the adjustment rod for supporting the bottom face of the table face board.

6. The game table assembly structure as claimed in claim 4, wherein the adjustment assembly further includes a seat section having a transverse wall, the seat section being fixedly connected with the at least one support board; the adjustment rod having a threaded rod section, the top section being disposed at a top end of the threaded rod section, the threaded rod section of the adjustment rod being screwed in a threaded hole of the transverse wall of the seat section.

7. The game table assembly structure as claimed in claim 1, further comprising at least two support blocks respectively located on inner surface of the two sideboards; a bottom end of the at least one support board being in contact with the two support blocks.

8. The game table assembly structure as claimed in claim 1, wherein each of the two ends of the at least one support board are respectively connected with the two sideboards by one connection member of two connection members, each said connection member having a main body and two wing sections located on the main body and spaced apart from each other, the main body of each said connection member being fixedly connected with a corresponding inner surface of the first sideboard; one end of the at least one support board being positioned between the two wing sections and connected with the wing sections.

9. The game table assembly structure as claimed in claim 8, wherein one end of the at least one support board is connected to the wing sections by a device selected from a group consisting of a pin and a threaded member.

10. The game table assembly structure as claimed in claim 1, further comprising at least one threaded member located on each connection board of the four connection boards, the at least one threaded member being adjustable up and down in height, the at least one threaded member having a top section located on a top end of the threaded member, the top section serving to support a surface selected from a group consisting of the bottom face of the table face board and a bottom face of a corresponding connecting board of the four connecting boards.

11. The game table assembly structure as claimed in claim 4, further comprising at least one threaded member located in each connection board of each of the four connection boards, the at least one threaded member being adjustable up and down in height, the at least one threaded member having a top section located on a top end of the threaded member, the top section serving to support a surface selected from a group consisting of the bottom face of the table face board and a bottom face of a corresponding connecting board of the four connecting boards.

12. The game table assembly structure as claimed in claim 10, wherein at least one nut is embedded in each of said connection board, the threaded member having a threaded rod, the threaded rod being screwed in the nut.

13. The game table assembly structure as claimed in claim 1, further comprising four table legs connected with the table frame.

14. A game table assembly structure comprising:

a table frame being a rectangular frame body and having two sideboards and two end boards connected with the sideboards;

the table face board has a bottom face, four connection boards in the form of elongated transverse slats, two first connection boards of the four connection boards being located on and connected to top edges of the two sideboards of the table frame; two second connection boards of the four connection boards being located on and connected to top edges of the two end boards of the table frame;

at least one support board located in the table frame, two ends of the at least one support board being respectively connected with the two sideboards;

four connecting boards being elongated and fixedly connected to the bottom face of the table face board, the four connecting boards corresponding with and being directly connected with the four connection boards, two first connecting boards of the four connecting boards corresponding to the two first connection boards; two second connecting boards of the four connecting boards corresponding to the two second connection boards;

the table face board is located above of the table frame, the four connecting boards and the four connection boards are located between the table face board and the table frame;

two locating members located on an outer side of the two second connecting boards and the two second connection boards, the two locating members restricting the two second connecting boards and the two second connection boards; and the four connection boards and the four connecting boards are connected together by multiple connection members thereby fixedly connecting the table face board with the table frame.

15. The game table assembly structure as claimed in claim 14, wherein the two locating members are located under the bottom face of the table face board and corresponding with the two second connecting boards respectively, bottom edges of the two locating members extending lower than the two second connecting boards, the two locating members restricting the two second connection boards.

16. The game table assembly structure as claimed in claim 14, wherein each said at least one support board has at least one adjustment assembly, the adjustment assembly including an adjustment rod, the adjustment rod is moveable up and down to adjust a height thereof, a top section being located at a top end of the adjustment rod for supporting the bottom face of the table face board.

17. The game table assembly structure as claimed in claim 14, wherein each of the two ends said of the at least one support board are respectively connected with the two sideboards by one connection member of two connection members, each said connection member having a main body and two wing sections located on the main body and spaced apart from each other, the main body of each said connection member being fixedly connected with a corresponding inner surface of the first sideboard; one end of the at least one support board being positioned between the two wing sections and connected with the wing sections.

18. The game table assembly structure as claimed in claim 14, further comprising at least two support blocks respectively located on inner surfaces of the two sideboards; the support blocks supporting a bottom end of the at least one support board.

19. The game table assembly structure as claimed in claim 14, further comprising at least one threaded member located in each connection board of each of the four connection boards, the at least one threaded member being adjustable up and down in height, the at least one threaded member having a top section located on a top end of the threaded member, the top section serving to support a surface selected from a group consisting of the bottom face of the table face board and a bottom face of a corresponding connecting board of the four connecting boards.

* * * * *